United States Patent [19]

Faulconer

[11] 4,169,645

[45] Oct. 2, 1979

[54] MEANS AND METHODS OF JOINING CONDUCTORS

[76] Inventor: Harry A. Faulconer, 8328 Center Dr., La Mesa, Calif. 92041

[21] Appl. No.: 852,781

[22] Filed: Nov. 18, 1977

Related U.S. Application Data

[60] Division of Ser. No. 494,900, Aug. 5, 1974, which is a division of Ser. No. 243,600, Apr. 13, 1972, Pat. No. 3,983,312, which is a continuation-in-part of Ser. No. 74,907, Sep. 23, 1970, Pat. No. 3,668,301, which is a continuation-in-part of Ser. No. 316, Jan. 2, 1970, abandoned, which is a continuation-in-part of Ser. No. 676,002, Sep. 28, 1967, abandoned, which is a continuation-in-part of Ser. No. 594,785, Nov. 16, 1966.

[51] Int. Cl.[2] ..... H01R 9/08

[52] U.S. Cl. ..... 339/98

[58] Field of Search ..... 339/97 R, 97 P, 98, 339/99

[56] References Cited

U.S. PATENT DOCUMENTS

| | | | |
|---|---|---|---|
| 3,417,368 | 12/1968 | Norden | 339/95 D |
| 3,496,522 | 2/1970 | Ellis, Jr. et al. | 339/99 R |
| 3,611,264 | 10/1971 | Ellis, Jr. | 339/99 R |
| 3,617,983 | 11/1971 | Patton | 339/98 |
| 3,772,635 | 11/1973 | Frey et al. | 339/99 R |
| 3,778,750 | 12/1973 | Caveney et al. | 339/97 R |

*Primary Examiner*—Joseph H. McGlynn
*Attorney, Agent, or Firm*—Kendrick, Netter & Bennett

[57] ABSTRACT

Method and apparatus for organizing and joining conductors of multi-conductor cables such as communication cables. An elongated multiple connector structure having a series of open-channels, the entrance ends of which are intersected by guide channels, each having a releasable holder at one end so that a bundle of wires may be separated, organized and held in the channels in bridging relation to connection sockets. Various types of releasable holders or retainers are disclosed including retainers which may also serve to strip insulation from a portion of each wire. Plugs are forced into the sockets and press bridging portions of the wires therein to strip the insulation and establish permanent electrical connections. Each socket is provided with a sharp edge to shear the excess portions of the wires as the plugs are forced into the sockets.

A compact assembly or array of elongated connector blocks and/or block segments may be formed by novel assembly components which include means for structurally connecting a selected wire or wires in a socket of a first block or segment with a selected wire or wires in a socket of a second block or segment mounted on the first block.

A single connector unit, particularly adapted for household use, is also disclosed.

3 Claims, 42 Drawing Figures

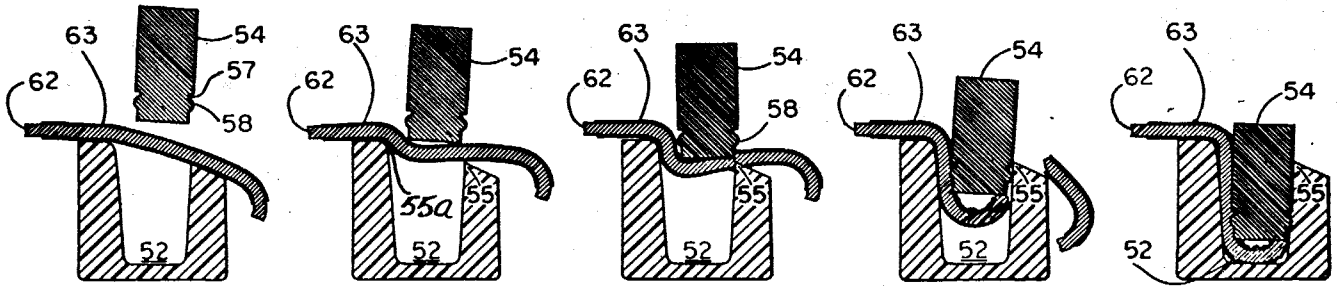
FIG. 5
FIG. 6
FIG. 7
FIG. 8
FIG. 9
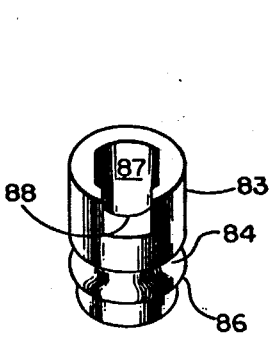
FIG. 10
FIG. 11
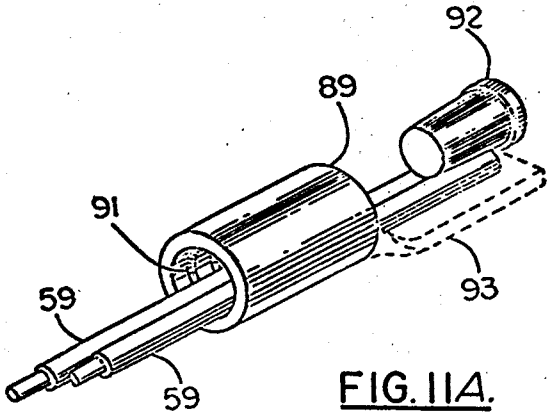
FIG. 11A.

FIG. 22.
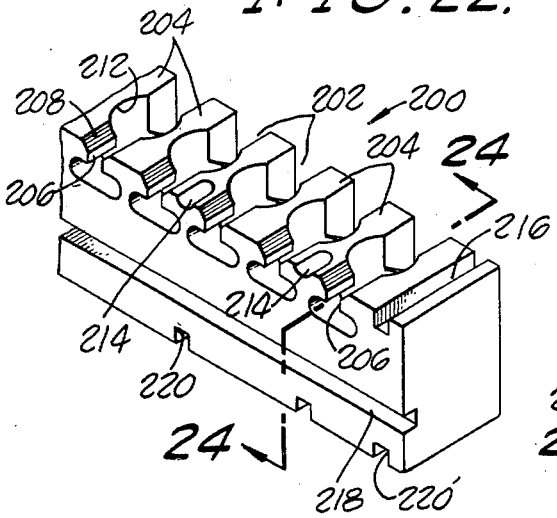
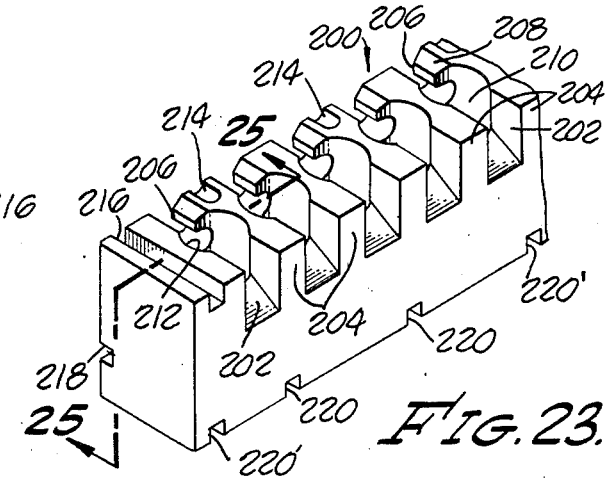
FIG. 23.
FIG. 24.
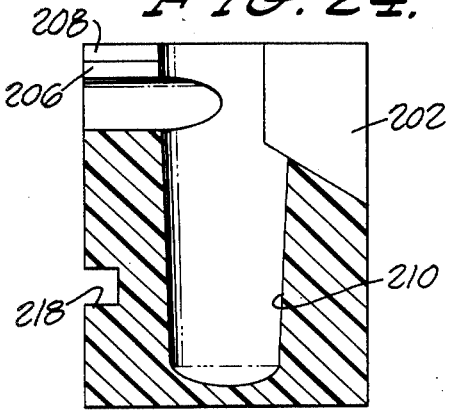
FIG. 25.
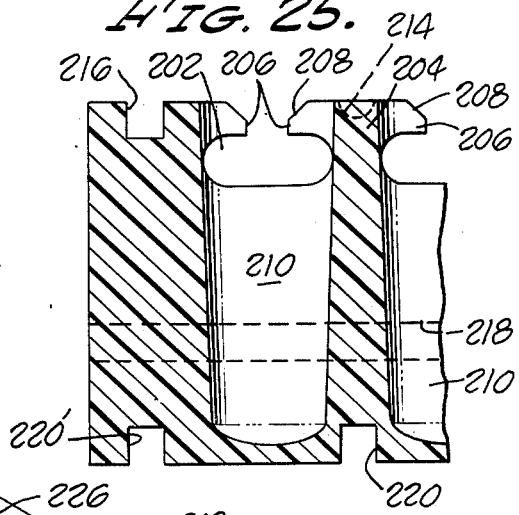
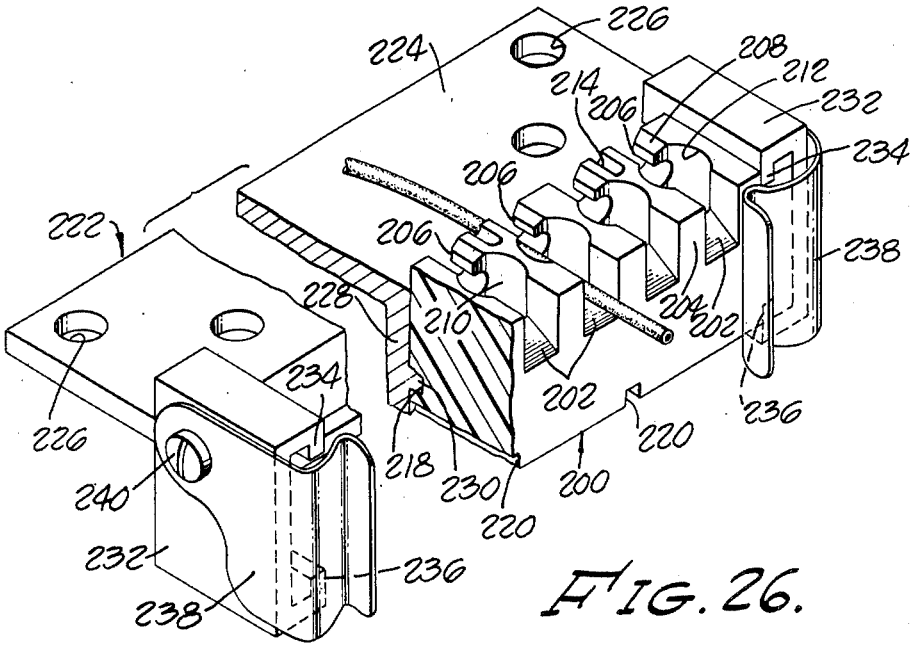
FIG. 26.

FIG. 31.
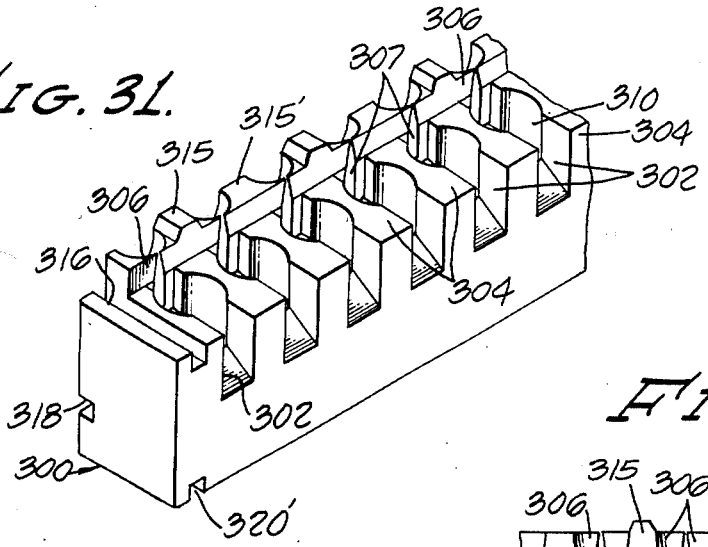
FIG. 32.
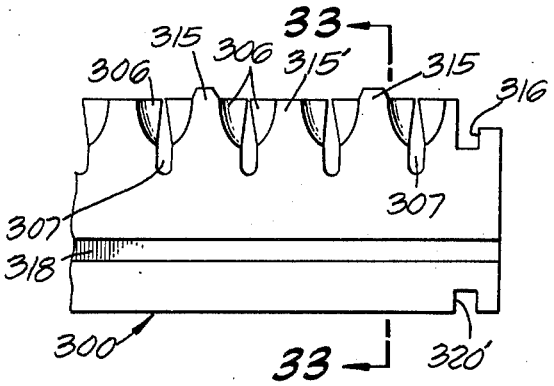
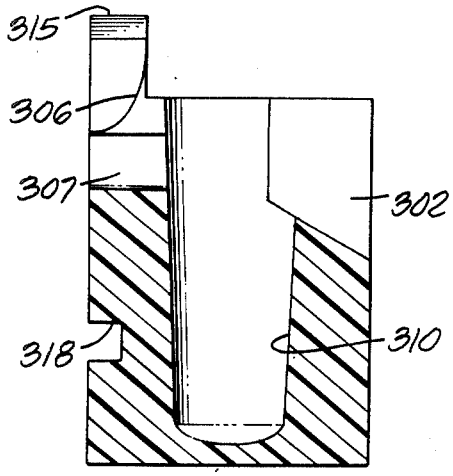
FIG. 33.
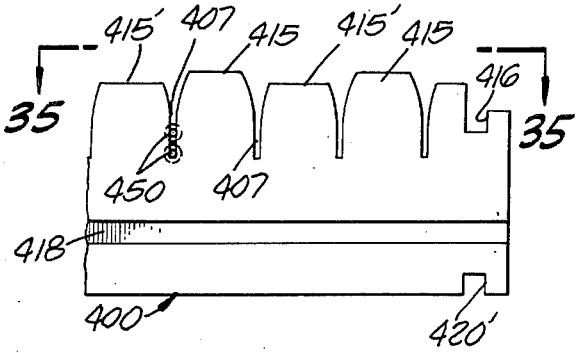
FIG. 34.
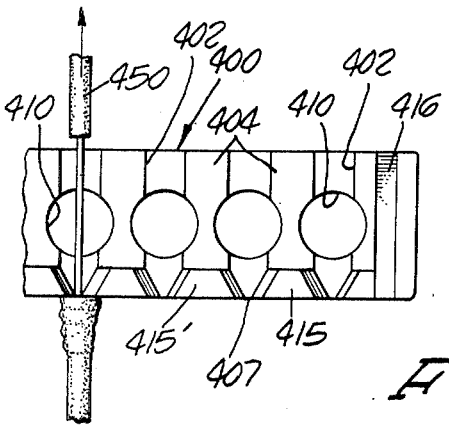
FIG. 35.

MEANS AND METHODS OF JOINING CONDUCTORS

RELATED APPLICATIONS

This application is a division of application U.S. Ser. No. 494,900, filed Aug. 5, 1974, which is a division of U.S. Ser. No. 243,600, filed Apr. 13, 1972, and now U.S. Pat. No. 3,983,312. Said Ser. No. 243,600 is a continuation-in-part of U.S. patent application Ser. No. 74,907, filed Sept. 23, 1970, U.S. Pat. No. 3,668,301, which is a continuation-in-part of Ser. No. 316, filed Jan. 2, 1970 and now abandoned, which is a continuation-in-part of Ser. No. 676,002, filed Sept. 28, 1967, now abandoned, which is a continuation-in-part of Ser. No. 594,785, filed Nov. 16, 1966.

BACKGROUND OF THE INVENTION

The joining of high pair count cables, such as used in the communications field, has involved the selection of mating pairs of wires, then joining these wires individually. Such connections have involved stripping of the insulation from the wires, then twisting the bare wires together, sometimes with the addition of solder to the twisted portion, or, more recently, the use of mechanical crimping devices, sometimes utilizing a sleeve which is slipped over the wires and their insulation, then crimped to pierce the insulation.

Each of the prior art methods is limited to joining individual pairs of wires, totally unorganized with respect to the cable as a whole. It is not uncommon to join communication cables having 2400 pairs of wires, requiring 4800 connections at each splice. Furthermore, cables of this size are 700 feet or less in length. Thus, the number of splices, the time consumed and resulting cost in soldering and covering each connection virtually eliminates this method. The crimping method is somewhat faster, but has the serious disadvantage, previously mentioned, of resulting in a totally unorganized splice, which is further aggravated by the greater bulk contributed by the crimp connectors.

A still further disadvantage exists, particularly in joining high pair count cables requiring hundreds of connections, in that prior art methods are conducive to human error as to the proper sorting and selection of wires and pairs of wires to be joined, and errors so made are not readily detectable until subsequent testing of completed cables. This being too late for corrective measures, pairs affected by such errors must be abandoned, resulting in the costly waste referred to in the industry as "dead copper", of which thousands of miles exist.

Considering the individual connectors whether used in the field of communication, or in other fields such as the joining of conductors used to transmit electrical power, the time required to effect a connection and the dependability of the connection leaves much to be desired. Considering the joining of high pair count cables, prior art methods are conducive to human error. No means is provided by known prior art methods for timely detection or correction of such erroneous connections, which are common and costly. Considering a completed splice in a multiple conductor cable, prior art methods make no provision for the permanent and orderly organization of the wires, which shortcoming is increasingly serious in view of the vast proliferation of installations where cables with large numbers of conductors must be interconnected.

SUMMARY OF THE INVENTION

The present invention provides a solution to the problem of effecting a permanent and orderly organization of the wires and groups of wires in the splicing of high pair count and other multiple conductor cables, and provides a fast efficient means of effecting dependable connection between two or more wires, whether in the communications field or wherever wires are joined for transmission of electrical signals or electrical power. Some of the objects of this invention are:

First, to provide a means and method of joining insulated conductors which is particularly applicable to the joining of communication cables which may contain hundreds of wires to be mated; more particularly, the means and method involves the use of elongated connector structures having means for holding a large number of wires for inspection and relocation of improperly placed wires, whereupon permanent connections may be made, and wherein the wires and groups of wires are retained in organized arrays.

Second, to provide a means and method, as indicated in the preceding object, wherein excess lengths of the wires are automatically severed, as the wires are joined, without mechanically or electrically weakening the connection.

Third, to provide a means and method of joining wires wherein one or more wires are placed in bridging relation across the entrance end of a socket and forced by a plug into the socket while simultaneously stripping the wire to make electrical connection as well as severing the excess wire.

Fourth, to provide a means and method of joining insulated wires which may comprise independent units to effect a single connection between mating wires and may be dimensioned for the joining of small wires such as used in the communication field or for the joining of large wires such as used in the power transmitting field.

Fifth, to provide a means and method of joining insulated wires, as indicated in the preceding objects, wherein a body of insulating material having one or more sockets is used to receive the wires and a conductor plug strips the wires to complete connection therewith; and, wherein the sockets may receive or be lined with conductive material to increase the area of electrical contact or to provide means for electrical connection between sockets.

Other objects and advantages will become apparent from the following description of embodiments of the invention.

DESCRIPTION OF THE DRAWINGS

FIGS. 5–9 represent a cross sectional view of one of the cavities of FIG. 4, showing the splicing operation in sequence.

FIG. 10 is an enlarged perspective view, showing a modified form of a single connector unit.

FIG. 11 is an enlarged perspective view, showing a modified form of connector plug which also forms a secondary connector.

FIG. 11A is a perspective view of another embodiment of a single connector unit constructed according to the teachings of the present invention.

FIG. 22 is a perspective view of another embodiment of a multiple-wire connector block constructed according to the teachings of the present invention, the block being viewed from the rear.

FIG. 23 is a front perspective view of the connector block shown in FIG. 22.

FIG. 24 is a sectional elevation view of the connector block shown in FIGS. 22 and 23, taken along the plane 24—24 in FIG. 22 and looking in the direction of the arrows.

FIG. 25 is another sectional elevation view of the connector block shown in FIGS. 22 and 23, taken along the plane 25—25 of FIG. 23 and looking in the direction of the arrows.

FIG. 26 is a front perspective view showing the manner in which the connector block of FIGS. 22 and 23 may be mounted on a temporary retaining fixture to facilitate connection of selected insulated wires thereto.

FIG. 31 is a front perspective view of still another embodiment of a connector block constructed according to the teachings of the present invention.

FIG. 32 is a rear elevation view of the connector block shown in FIG. 31.

FIG. 33 is a sectional elevation view of the connector block shown in FIGS. 31 and 32, taken along the plane 33—33 of FIG. 32 and looking in the direction of the arrows.

FIG. 34 is a rear elevation view of another embodiment of a connector block constructed in accordance with the teachings of the present invention.

FIG. 35 is a top plan view of the connector block shown in FIG. 34.

DESCRIPTION OF EMBODIMENTS OF FIGS. 1-21

Figure 1:
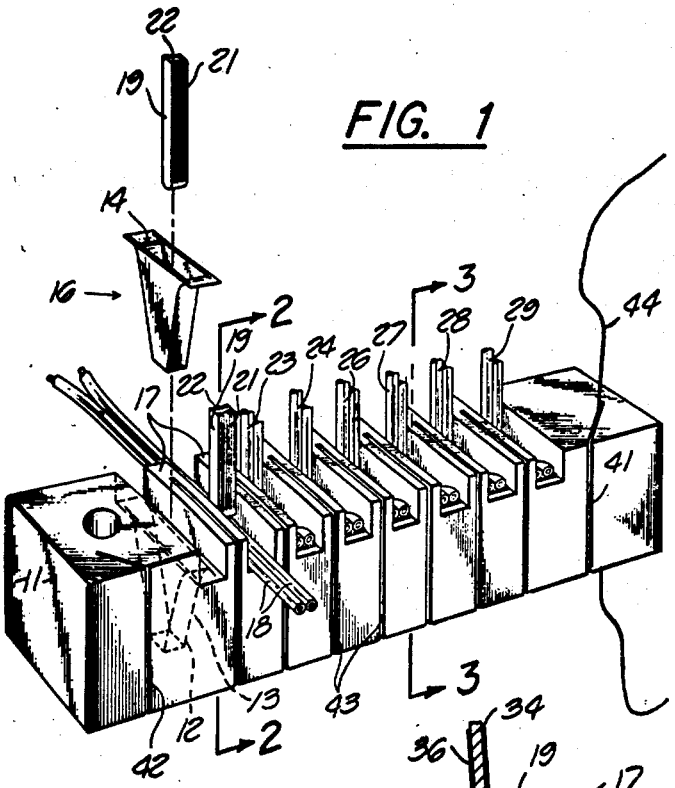
FIG. 1 is an enlarged perspective view of an embodiment of a multiple wire connector included in the present invention.

Referring to FIG. 1, a terminal insulating block 11 has a plurality of tapered cavities or sockets 12. Each tapered cavity 12 has a pair of opposite converging walls 13 which are lined with a conductive strip 14. The conductive strip 14 may merely line two converging sides of the cavity, or be in the form of a rectangular cross sectioned tapered socket or funnel, as indicated by 16, and line all four sides of the cavities 12.

Extensions 17 of insulative terminal block 11 form convenient guides and dividers between each cavity for the placement of a pair of conductors 18 in the open channel or trough formed therebetween. Conductive inserts 19 are dimensioned for a snug fit within cavities 12 and have a plurality of splines on opposite faces 21 and 22. Conductor pairs 23, 24, 26, 27, 28 and 29 are shown after the splicing operation has been completed. Conductor pair 18, with a corresponding insert 19, is shown just prior to the completion of an electrical splice.

A plurality of slots 43 are provided in each extension 17 along with angled slots 41 and 42 in each end of insulating block 11. These slots facilitate the bending of the entire terminal block after the aplicing operation is completed. Angled slots 41 and 42 can be utilized for tying the terminal strip in arcuate configuration surrounding a bundle of conductors or cable. A string 44 is shown positioned within angled slot 41 for cooperation with angled slot 42 after the terminal block is bent.

Figure 2:
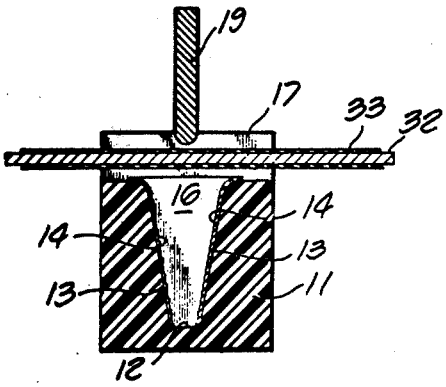
FIG. 2 is a cross sectional view thereof, taken from 2—2 of FIG. 1.

Referring to FIG. 2, a cross-section along lines 2—2 is shown with insert 19 in a position just prior to a splice being made in spatial relationship with a conductor 32 having an insulative sleeve 33 thereon. The conductor 32 is placed over tapered cavity 12 having conductive strips 14 lining a pair of converging walls 13 in insulative terminal block 11. One extension 17 is shown rising above conductor 32.

Figure 3:
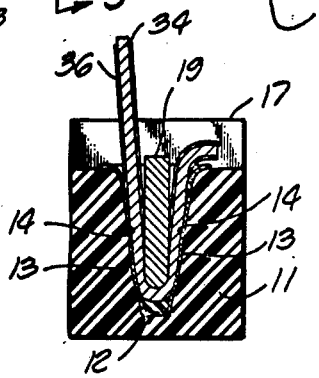
FIG. 3 is a cross sectional view thereof, taken from 3—3 of FIG. 1.

Referring to FIG. 3, a cross sectional view taken along line 3—3 of FIG. 1 is shown which is essentially the same as FIG. 2 with the exception that the splicing operation has been completed. Here, an individual conductor 34, with an insulative sleeve 36, is shown within tapered cavity 12 of insulative terminal block 11. Insert 19 has driven conductor 34 into the tapered cavity 12 and in electrical contact with conductive strips 14 which line converging walls 13 of tapered recess 12. As can be seen the conductive block, together with the conductive strips 14, have been displaced at 37 from the pressure of insert 19 thereon. Insulative sleeve 36 has been destroyed in the lower regions of the tapered recess 12, causing an electrical contact between conductor 34 and conductive insert 19.

Figure 4:
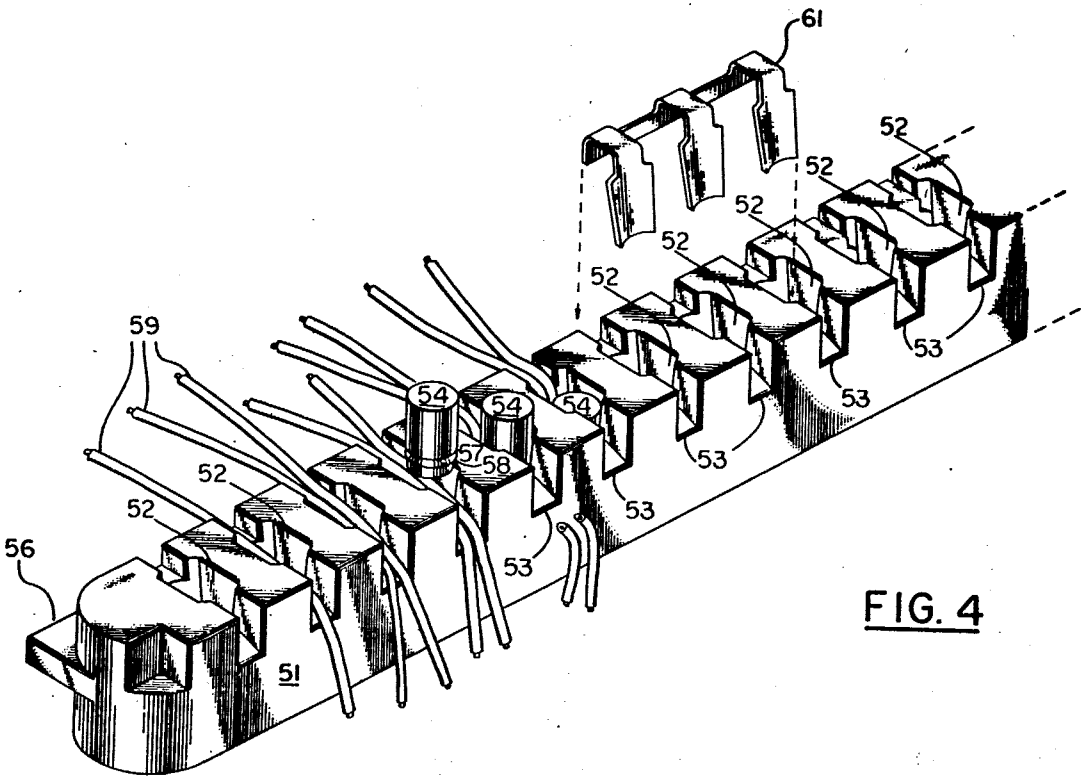
FIG. 4 is an enlarged fragmentary perspective view of another embodiment of a multiple wire connector included in the present invention.

Referring to FIG. 4, a modification of the terminal block splice of FIG. 1 is shown utilizing a relatively rigid insulative terminal block 51, having a plurality of tapered cavities 52. Each of the tapered cavities 52 has a forward shearing edge (not shown) terminating the top front edge of each cavity 52. Each cavity has an associated lead recess 53 for sorting and dressing a plurality of leads for the future insertion of inserts 54. It is also to be noted that each cavity 52 comprising a wire connection location is associated with a separate open-faced channel 52' formed by upstanding portions of 51. A back ledge 56 forms a convenient mounting extension for mounting the insulative strip in proximity to a pair of multiconductor cables, for example, being spliced.

Insert 54 has an annular recess 57 and an annular extension 58 for effecting a parting of the insulation of electrical leads 59 within cavities 52. In this embodiment, the cavities or sockets 52 each form a conical section for cooperation with cylindrical inserts 54. If required, selected cavities may be electrically connected; for example, a shorting bar 61 is shown in proximity with three of the cavities 52 for electrically shorting all conductors within these cavities.

Referring to FIGS. 5–9, a sequential progression of an insertion of insert 54 into a cavity 52 carrying with it electrical conductor 62 having an insulative sleeve 63 is shown. Again, insert 54 has an annular recess 57 and an annular extension 58. Cavity 52 has a shearing edge 55 on one side thereof; however, the opposite edge is rounded to form a non-shearing edge 55*a*. As the insert 54 is forced into the cavity 52, the insulated wire or conductor 62 is drawn and folded over the non-shearing edge 55*a*, while the shearing edge 55 cooperates with the insert 54 to shear the excess portion of the wire. As the insert 54 is forced further into the socket 52, the lower edge of the insert adjacent the non-shearing edge cuts through the insulation and continues to draw the wire downwardly into the socket and the annular extension or rib 58 presses into the bare wire. By reason of the folded condition of the wire at 55*a* and the pressure contact of 58, excessive tension applied to the wire will cause the wire to fail at some point prior to the connector rather than at the connector itself.

Referring to FIG. 10, here the connector is indicated as a generally cylindrical member 81, having a single cavity or socket 52. Also, a spherical insert 54*a* is indicated. The spherical insert 54*a* cooperates with the shearing edge 55 as previously described.

Referring now to FIG. 11, there is illustrated a conductive insert 83, which is, externally, similar to the insert 54 in having an annular recess 84 and rib 86 corresponding to the recess 57 and rib 58. The insert 83 is sufficiently large to have a socket 87 corresponding to the socket 52, and within which an insert 54 can be received in the manner illustrated in FIGS. 5–9.

Figure 12:
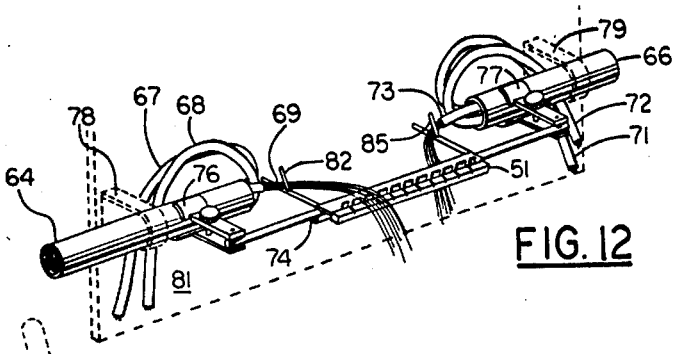
FIG. 12 is a schematic perspective view, illustrating a step in the joining of a pair of multiple conductor, multiple bundle cables.

Referring to FIG. 12, a pair of multi-conductor cables 64 and 66 are shown in the process of being spliced. Multi-conductor cable 64 has groups of conductors 67, 68 and 69. Similarly, multi-conductor cable 66 has groups of conductors 71, 72 and 73. An insulative terminal block 51 is shown mounted by mounting brackets 74, 76 and 77 to multi-conductor cables 64 and 66. Multi-conductor cables 64 and 66 are mounted as shown in phantom by straps 78 and 79 to a surface 80.

Figure 13:
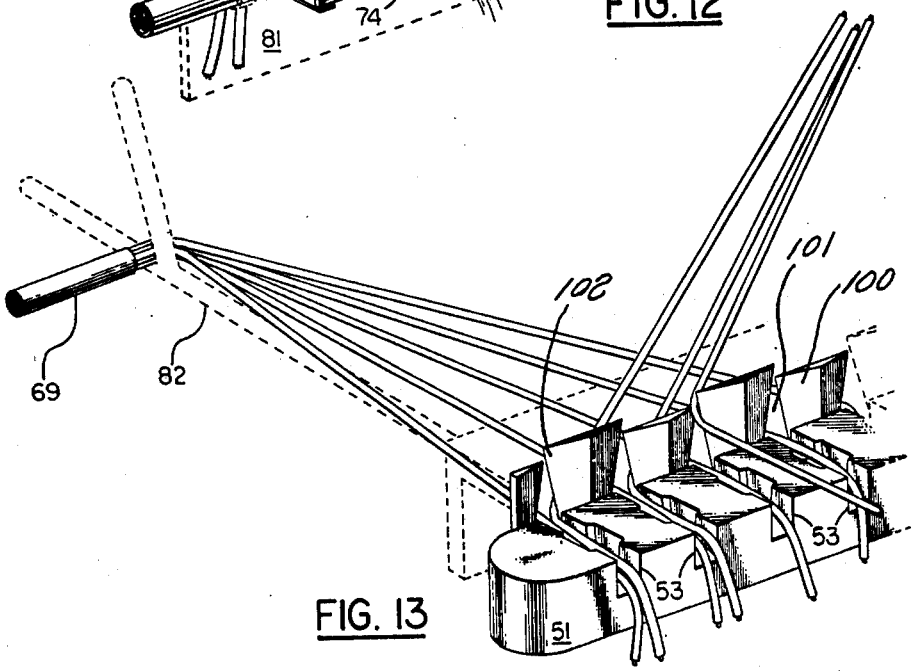
FIG. 13 is an enlarged fragmentary perspective view, showing a modified form of a connector wherein releasable wire retaining means hold the wires in place during assembly and inspection.

Referring to FIG. 13, one group of conductors 69 is shown being passed through a holding bar 82 with the conductors fanned out and individually received in the channels or recesses 53 in bridging relation to the sockets 52 together with similarly placed individual conductors from group 73 (FIG. 12) ready for a completion of the connection.

Also shown in FIG. 13 at the entering side of the terminal block 51 is a row of upwardly extending wire retainers 100 forming downwardly diverging slots 101 aligned with the recesses 53. Alternate retainers extend above the other retainers, as indicated by 102, so that a wire may be laid across the end of a slot retainer and slipped sidewise into and forced into the entrance end of the slot.

Specifically, the upstanding retainers 100 and 102 serve, first, to guide the cable wires during initial emplacement in preselected connection locations, that is, within given channels or recesses 53; and, second, to frictionally engage the mated wires after emplacement and maintain them with the predetermined channels while effecting connection. This retention, which is also aided by frictional contact of the wires with the walls defining the open channels 53, although more sufficient for holding mated wires within selected connection locations while other wires are being similarly located and connected, still permits ready removal or wires and emplacement in other connection locations in case of error.

Referring particularly to FIGS. 4, 12 and 13, the wires from, for example, group or bundle 69 are placed in the grooves or recesses 53 extending generally transversely of the block 51 and the sockets 52. Also, at this time the wires are removably held, as indicated in FIG. 13, within the channels or recesses 53, by the confining action of retainers 100. During or following placement of the wires, if any errors are noted, the wires are changed accordingly. After the wires from one group or bundle have been placed, the wires from another group or bundle, for example 73, are placed in mating relation to the wires of the first bundle, extending transversely of 51 with each wire located at a predetermined wire connection location, and if any errors in placement occur, proper relocation is made.

Upon determination that the wires are correctly placed, the inserts 54 are forced in place. This may be done individually or collectively by suitable inserting and pressing tools having magazines to carry and dispense the inserts. Such tools are not included in the present invention.

Exemplary to such tools is that described in copending U.S. Pat. application Ser. No. 761,097, entitled MAGAZINE-EQUIPPED SLUG-DRIVING TOOL, by Harry A. Faulconer and Douglas Arnold, filed Sept. 20, 1968.

Figure 14:
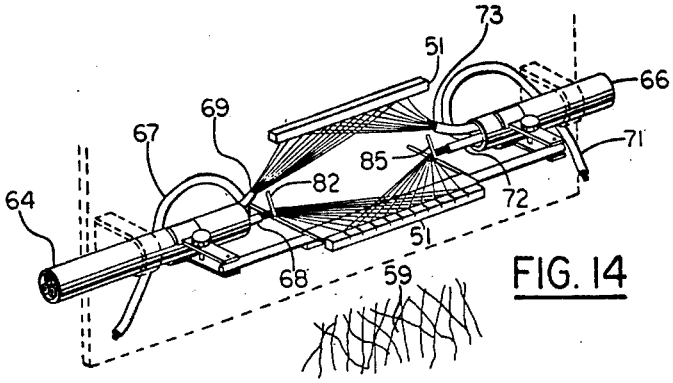
FIG. 14 is a schematic perspective view, similar to FIG. 12, showing a further step in the joining of a pair of multiple conductor, multiple bundle cables.

Referring to FIG. 14, conductor groups or bundles 69 and 73 of multi-conductor cables 64 and 66, respectively, are shown joined together within an insulative terminal strip 51 and moved aside so that conductor groups or bundles such as 68 and 72 are shown as held by the guide bars 82 and 85, respectively, and the wires placed in another insulative terminal strip 51; the second terminal strip being shown completed ready for alignment adjacent to the first terminal strip. A plurality of individually sheared conductors 59 is shown illustrating the completion of the splice.

Figure 15:
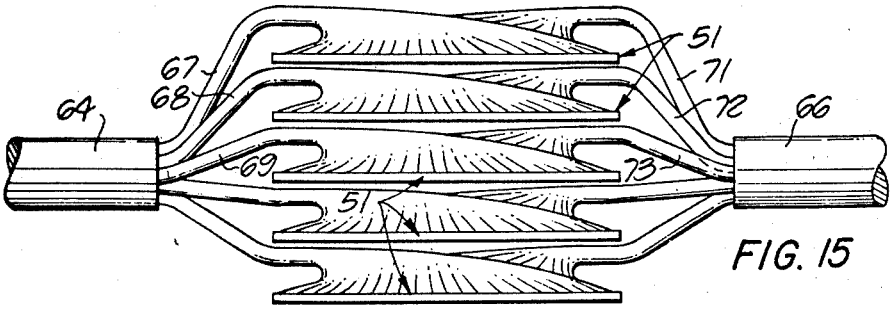
FIG. 15 is a diagrammatical front view, illustrating a further step in the joining of a pair of multiple conductor, multiple bundle cables.
Figure 16:
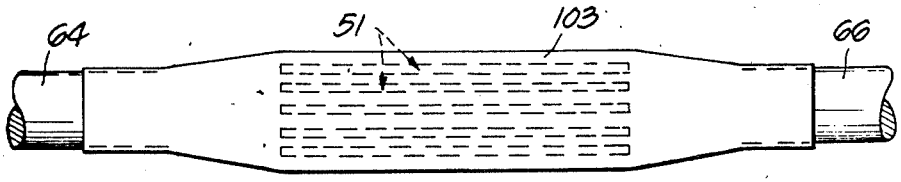
FIG. 16 is a diagrammatical view, showing a completed connection between a pair of multiple conductor, multiple bundle cables.

Referring to FIG. 15, the completed terminal strips 51 tend to occupy an essentially parallel relationship with each other and the cables being joined, with the wires, indicated collectively, curving laterally and converging to their respective cable bundles. After connection between the cables is made, the terminal strips and wires are pressed together into a compact bundle generally colinear with the cables and wrapped with a suitable covering 103, as indicated in FIG. 16.

Figure 17:
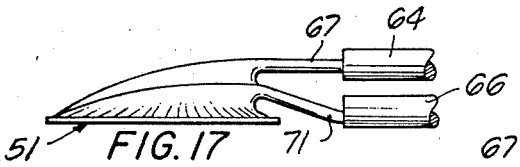
FIG. 17 is a diagrammatical view, showing the manner of connection to a pair of cables located side-by-side.
Figure 18:
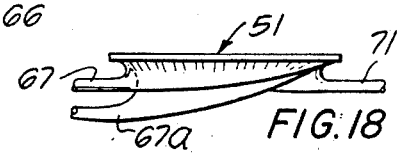
FIG. 18 is a diagrammatical view, showing a manner of connection between three cables.

While usually the cables 64 and 66 are located in coaxial relation, this need not be the case for they may be in angular or offset relation, or may be side-by-side, as indicated in FIG. 17. Still further, it may be desirable to provide lateral branches of cable bundles, as indicated by **67*a* in FIG. 18**. In this case, three wires are joined in each socket or selected sockets instead of a pair of wires.

Figure 19:
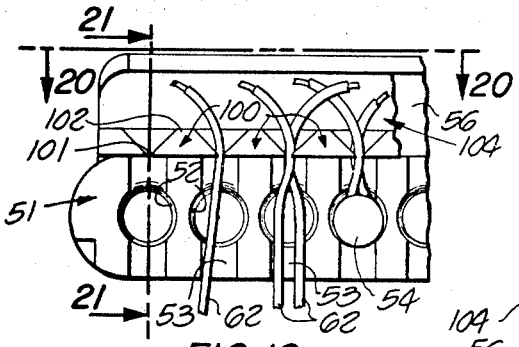
FIG. 19 is an enlarged fragmentary top view of a further modification of the multiple wire connector.
Figure 20:
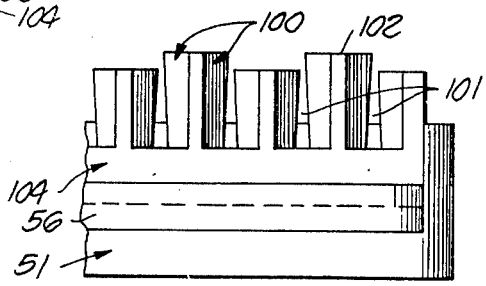
FIG. 20 is a fragmentary front view as seen from 20—20 of FIG. 19.
Figure 21:
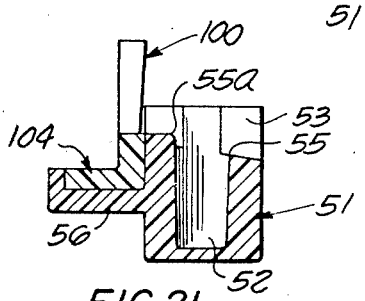
FIG. 21 is a transverse view thereof, taken through 21—21 of FIG. 19.

Referring to FIGS. 19, 20 and 21, the construction illustrated is similar to the constructions shown in FIGS. 4 through 9 and FIG. 13, and corresponding parts are indicated by the same reference numerals. In this construction, the ledge 56 supports a body 104 of angular cross section which supports the wire retainers 100. It is desirable that the wire retainers be made of different plastic material than the terminal strip or body 51 for the reason the body 51 should be formed of relatively strong plastic in order to provide a dependable shearing edge 55, even though each shearing edge is used only once. Also, the wire retainers may be formed of relatively soft or yieldable plastic which deforms to admit the wires or yield or combine both properties. It is further pointed out that the shearing edge is slightly lower than the back edge of the insert which permits the wire to be folded prior to shearing to ensure that the wire is drawn into the socket so as to effect a positive and permanent mechanical binding within cavity 52.

The method of joining multiple conductor cables involves essentially the following steps or groups thereof:

The cables are arranged in fixed spaced relation with the bundles of wires extending a sufficient distance that they overlap. The terminal body supporting framework is secured with respect to the cables and a terminal body is clamped or otherwise secured in position so that wires from the bundles of both cables may be brought to and beyond the terminal body.

A single bundle from one of the cables is selected and the wires separated or fanned out so that they may be respectively placed in the retainer slots 101 and laid in the channels 53, bridging the associated sockets 52 and thereby extending generally transversely of the terminal block 51. As the wires are placed and on completion of placement, the wires are inspected and appropriate correction made if needed. Next, a mating bundle from the other cable is selected, the wires separated and mated with the first set of wires. Again inspection and appropriate correction is made if needed. If connection is to be made to a third cable, as shown in FIG. 18, the steps are again repeated for that cable.

After determination that the wires are properly placed and mated, the inserts or plugs are forced in the corresponding sockets. As indicated, previously, a tool, not included in the present invention, is employed. Preferably, such tool includes a magazine for carrying a plurality of inserts or plugs and jaws which align the plugs with corresponding sockets either simultaneously or sequentially. Also, the tool may be either manually or power operated. As each plug is inserted, the excess length beyond the connection point is severed.

When each terminal body is completed, it is moved clear of the clamping means and a succeeding terminal body is secured in place and with placement and electrical connection of the mating wires accomplished in the manner described.

When all of the bundles of wires have been joined, the terminal bodies and the wires are pressed together into a composite or master bundle and wrapped. No insulation is needed between the terminal strips as they are formed of insulation material.

The present invention has its greatest utility in establishing electrical connection between select wires of two or more sets of wires or multi-wire cables where the number of wires or conductors in each set or cable ranges from, say, eight (FIG. 1) to many times that number. That is, the technique of this invention is especially advantageous in providing for the arranging of a large number of sets of two or more wires per set at individual connection locations on a connector terminal where the wires are selected from multi-wire cables which can comprise individually literally hundreds of wires.

A still further important aspect of the subject invention is its applicability to the making of "in-service" connections. For example, two or more wires that are in use, and which it is desired to interconnect, can be located in, say, a channel 53 of a terminal block 51 and connected together in the manner described herein with service only being interrupted for that short period of time required to drive an insert 54 into the associated socket 52. This substantially instantaneous connection ability, not requiring lengthy interruption of service is important particularly when working with communication circuits since it is a basic requirement there that when a line is to be taken out of service, users must be notified ahead of time. However, the timer required to connect such in-service lines by the present invention is measured in the millisecond range and is, therefore, so short that no prior notification or other special measures have to be taken.

While the present invention is directed primarily to the connection of multiple conductor cables, it should be noted that the connector may be arranged in single units to effect a single joint between two or more wires. Still further, the connector may have only a few sockets which may be electrically connected and the wire or wires and their sockets may be of different size, to effect, for example, connection between wires of substantially different size.

It is customary to arrange the wires of communication cables in pairs which are distinctively colored; one color designating the "tip" or positive wire, the other designating the "ring" or negative wire. It has been conventional practice to separate or "split" a wire pair from one cable and join the wires to a pair of split wires from the other cable by means of two separate connectors.

Referring to FIGS. 13 and 20, the provision of alternate retainers of greater height permits a pair of split wires to be handled simultaneously. That is, each pair is separated sufficiently to clear an extended retainer 102 with one color consistently to the left and the other to the right, then, while held in one hand, lowered to the shorter retainers flanking the extended retainer. A slight pull draws the wire pair against the sides of the extended retainer and a downward pull causes the wires to be drawn into corresponding slots 101. This movement can be accomplished rapidly, thereby materially reducing the time required to effect the multiple connections between cables. Furthermore, the chance of error is minimal.

DESCRIPTION OF EMBODIMENTS OF FIGS. 22–41

FIGS. 22–29 illustrate a modified form of a connector block and connector block segments which are particularly adapted to be employed in a stacked array.

An elongated connector block 200 adapted for use in a stacked array is shown in FIGS. 22–25. The elongated block 200 includes a plurality of spaced, parallel channels 202 separated from one another by upstanding dividers 204 of the block.

As best shown in FIG. 25, the upstanding dividers 204 of the block 200 have laterally extending projections 206 on the rear ends thereof. These lateral projections 206 extend across a portion of the rear ends of the channels 202 to retain wires in the channels in a manner described more fully below. Each projection has a bevelled or inclined ramp portion 208 on the upper side edge thereof to facilitate insertion of wires into the channels.

As best shown in FIGS. 24 and 25, downwardly extending sockets or cavities 210 are provided in the connector block for receiving and retaining the terminal ends of electrical wires to be connected. One such socket or cavity 210 is provided between each adjacent pair of upstanding portions 204. Each socket 210 is adapted to receive one, two or more electrical wires to be connected. The sockets are generally cylindrical, may be slightly tapered, and are particularly designed to receive conductive inserts such as the insert 54 shown and described above in connection with the embodiment of FIGS. 4–9. The central side portions of each upstanding portion 204 may have arcuate cuts 212 therein to facilitate insertion of the cylindrical inserts or plugs into the sockets or cavities 210.

It will be noted that the connector block 200 has a rectilinear profile which facilitates stacking of these blocks and/or similar block segments to form a compact array. The upper rear surfaces of alternate ones of the upstanding dividers 204 may be provided with suitable indicia, such as the trough-shaped depressions or indentations 214 to facilitate identification of wire pairs. The alternate dividers 204, whih are not provided with such depressions 214 may then be readily recognized as the "pair-splitting" dividers to assure the user that one wire (e.g., the positive or "tip" wire, in a communications wire network) is placed on one side of the divider and the other wire of the pair (e.g., the negative or "ring" wire) is positioned in the channel 202 on the other side of the divider.

A transversely extending groove is provided in the top surface of the connector block 200 at each end thereof, and a longitudinally extending groove 218 is provided in the rear surface of the block, and a plurality of spaced, transversely extending grooves 220 are provided in the bottom surface of the block, the end grooves being designated 220'.

One such fixture 222, shown in FIG. 26, is designed to retain the connector block 200 temporarily while the wires to be joined are inserted and connected in place. The fixture 222 includes a horizontal plate 224 having apertures or holes 226 therein for securing the fixture on a suitable support. A vertical wall 228 extends downwardly from the horizontal plate 224 and has a horizontal ledge 230 projecting therefrom. As shown in FIG. 26, the ledge or projection 230 is adapted to be snugly received in the longitudinally extending groove 218 in the backside of the connector block 200 to releasably retain and rigidly support the block 200 on the fixture 222, with the backside of the block against the vertical wall 228 of the fixture 222.

The fixture 222 also has generally C-shaped brackets 232 extending outwardly from the ends of the plate 224 for securely retaining the ends of the connector block 200. Each of the brackets 232 includes a downwardly projecting leg 234 adapted to be snugly received in the transverse groove 216 in the upper end surface of the block, and an upwardly projecting let 236 adapted to be received in an end groove 220' in the bottom surface of the block 200. As shown in FIG. 26, the vertical wall 228 and the horizontal ledge 230 support the block 200 from the rear, and the brackets 232 support the block from the sides. Each flange 238 is rotatably mounted on the outer side of its associated bracket 232 by a screw 240 for pressing the block 200 against the vertical wall 228.

It will be appreciated that the fixture 222 may serve as a convenient device for temporarily retaining a connector block 200 while wires to be joined are inserted and connected in the block.

It may also be appreciated, from viewing FIG. 26, that the horizontally extending projections 206 on the sides of the rear portions of the upstanding dividers 204 serve to retain the wires in each channel, and prevent inadvertent upward removal of the wires from the channels.

Figure 27:
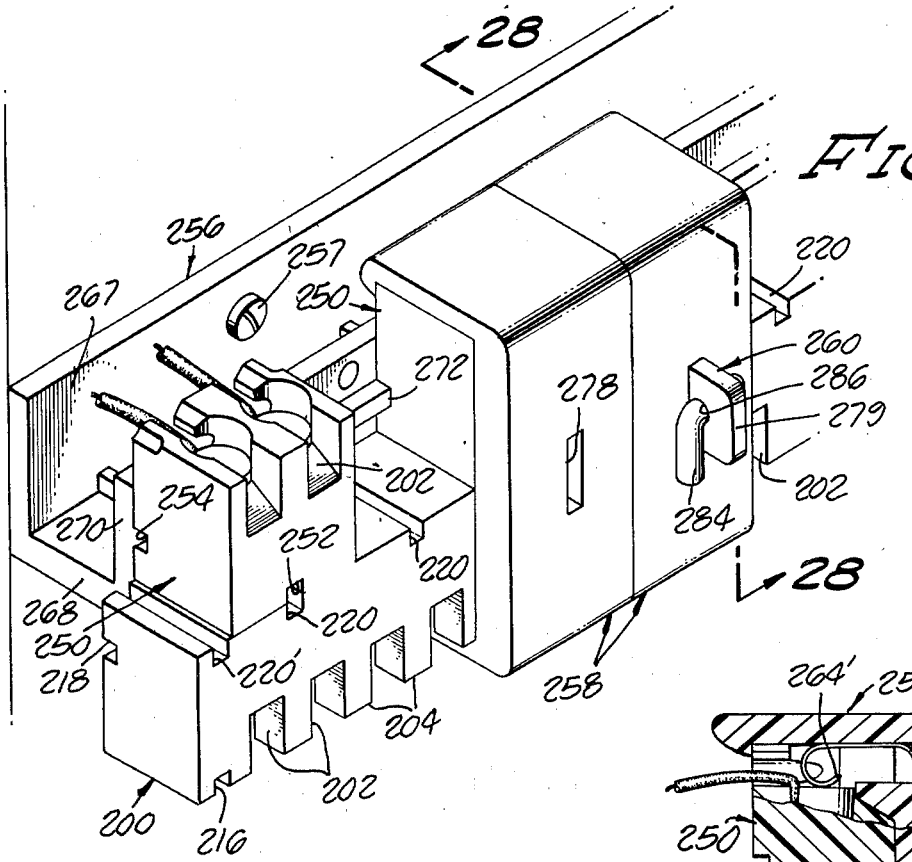
FIG. 27 is a front perspective view of an installation of connector blocks constructed according to the teachings of the present invention, said assembly including the connector block structure of FIGS. 22-26 in an inverted position, with connector block segments mounted and retained thereon by suitable retaining structures.

FIG. 27 illustrates the manner in which connector blocks 200 of the type shown in FIGS. 22–26 may be assembled in a stacked array with connector block segments 250 for connecting wire pairs, one pair at a time, to selected pairs of wires which have been connected previously in a block 200.

As best shown in FIG. 27, the connector block segment 250 is identical to the connector block 200, except that it is shorter and is not provided with the transverse end grooves such as grooves 216 and 220' in the ends of the block 200.

The connector block segment 250 is provided with a groove 252 in its bottom face. The groove 252 is adapted to align with one of the grooves 220 in the connector block 200 when the block 200 is inverted (as shown in FIG. 27) and the block segment 250 is stacked bottom-to-bottom on the block 200.

Figure 28:
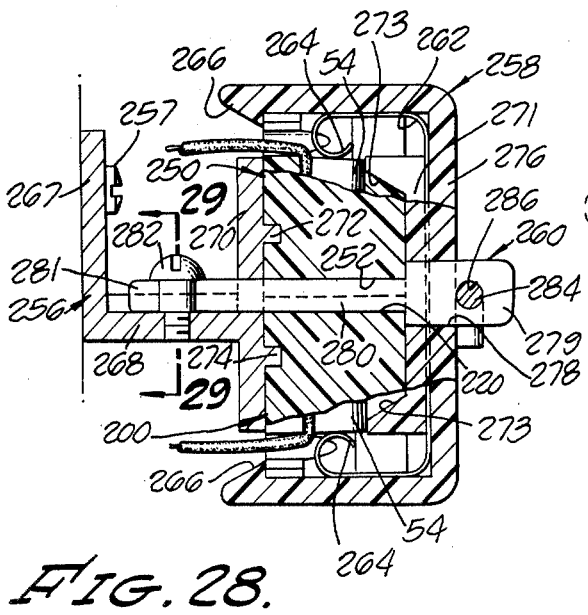
FIG. 28 is a sectional elevation view of the assembly shown in FIG. 27, taken along the plane 28—28 of FIG. 27 and looking in the direction of the arrows.

As best shown in FIG. 28, the individual connector block segments 250 and the connector block 200 are structurally and electrically connected by means of a mounting fixture 256, a C-shaped clamp 258 which has a generally C-shaped spring-clip 262 suitably secured (e.g., by sonic welding) to its inner surface, and an indexing finger 260.

Referring to FIG. 28, it will be seen that the spring clip 262 has inwardly-turned end portions 264—264 which contact and electrically connect the conductive inserts or plugs 54 in the cavities or sockets of a connector block 200 and a block segment 250. As described above in connection with the embodiments of FIGS. 1–21, each conductive plug or insert 54 is in electrical contact with the terminal end or ends of the wire or wires in its associated socket 210. The spring clip 262 is made of a conductive material and establishes electrical connection between the wire or wires in one of the sockets 210 of the block segment 250 and the wire or wires in the socket 210 of the block 200 which is directly beneath it.

The clamp 258, which is preferably constructed of a relatively flexible, insulative material (e.g., glass-filled nylon) snaps over the top surfaces of the block segment 250 and the block 200 to maintain the block segment 250 in bottom-to-bottom relationship on the inverted block 200. It will be noted, from FIG. 28, that the ends of the clamp 258 are provided with extensions or lips 266 which snap over the upper rear surfaces of the segment 250 and the block 200 to maintain them in vertical alignment.

Each clamp 258 is provided with a pair of spaced, parallel indexing protruderances 271 having upper and lower ramp surfaces 273 adapted to be received in the forward portions of the channels 202 in the connector block 200 and the corresponding block segment 250 (see FIG. 28). These indexing ramps 273 function to assure positive alignment of the associated channels 202, 202 in the connector block 200 and the block segment 250. The protruderances 271 are preferably made in two halves with the conductive spring clip 262 disposed therebetween.

The segment 250 and the block 200 are also maintained in assembled relation by means of the mounting fixture 256 which includes a vertical mounting 267, a horizontally extending wall 268 integrally connected to the bottom of the mounting plate 267, a vertical wall 270 integrally connected to the other end of the horizontal wall 268, and a pair of substantially parallel, vertically-spaced horizontal ledges or projections 272, 274 which are adapted to be snugly received by the longitudinally extending grooves 254 and 218, respectively, in the segment 250 and the block 200. The fixture 256 is adapted to be secured to a fixed support, as by screws 257 through plate 267 (FIG. 28).

It is to be noted that in some situations it may be desirable to have the array or assembly unsecured or "free-floating", and the support fixture 256 may be eliminated. (See, for example, the array of FIG. 30, described below).

The vertical wall 276 of the clamp 258 is provided with a slot 278 for receiving the enlarged end or head 279 of the indexing finger 260. As best shown in FIG. 28, the indexing finger 260 includes an elongated shaft 280 which extends forwardly from the head 279 and into the channel formed by the aligned slots 252 and 220 in the block segment 250 and the block 200, respectively. The forward end 281 of the shaft 280 is adapted to be secured to the horizontal wall 268 of the mounting fixture 256 by the head of a screw 282 in the wall 268 (see FIG. 29). A keeper bar 284 extends through a hole 286 in the head 279 of the indexing finger 260 to prevent accidental removal of the clamp 258.

Thus, the indexing finger 260 maintains the block 200, block segment 250, fixture 256 and clamp 262 in assembled relationship. The shaft 280 alignment of the channels 252, 220 and sockets of the block segment 250 with the associated, proper channels and sockets in the block 200 by precluding lateral movement of the segment with respect to the block.

The rear end of the shaft portion 280 is detachably secured to the horizontal wall 268 of the fixture 256 by means of a screw 282. A keeper 284 fits through an aperature 286 in the head 278 of the index finger 260 to further insure against inadvertent removal of the clamp 258.

Of course, it is contemplated that it may be desirable, in some situations, to stack two connector blocks 200 bottom-to-bottom. In such a situation it would be desirable to have the clamp 258 of a length equal to the length of the blocks 200, with a plurality of spaced spring-clips 262 secured to the inner surface of the elongated clamp.

Figure 30:
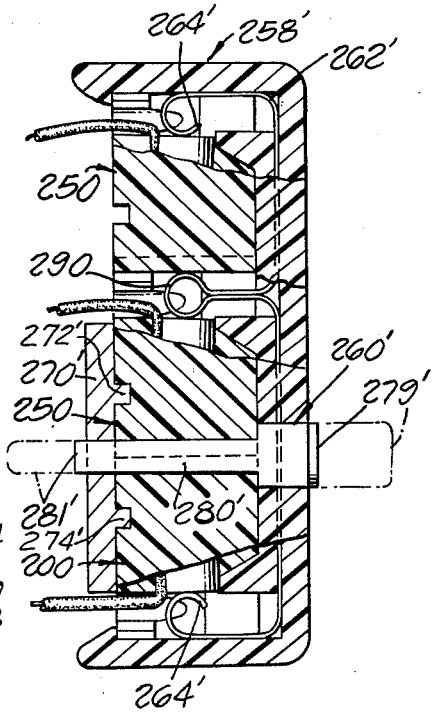
FIG. 30 is a sectional elevation view illustrating still another manner in which connector blocks of the type shown in FIGS. 22-26 and 27-29 may be assembled in a stacked-module array.
Figure 29:
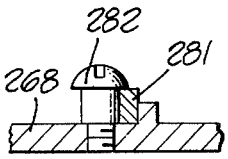
FIG. 29 is a sectional elevation view of a portion of the assembly shown in FIGS. 27 and 28, taken along the plane 29—29 of FIG. 28 and looking in the direction of the arrows.
Figure 36:
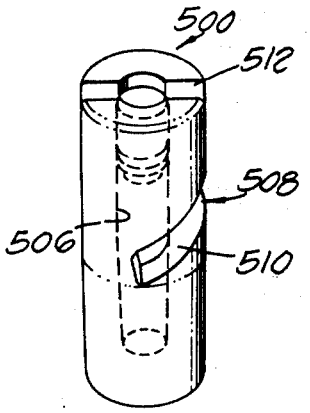
FIG. 36 is a perspective view of a perspective view of another embodiment of a connector member constructed in accordance with the teachings of the present invention.
Figure 37:
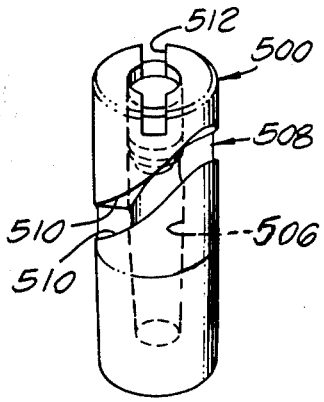
FIG. 37 is a perspective view of the connector member of FIG. 36 as the connector member appears when rotated approximately 90 degrees, in a clockwise direction, from the position of FIG. 36.
Figure 38:
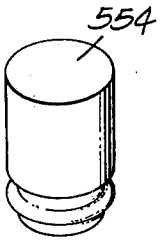
FIG. 38 is a perspective view of the plug which forms a part of the connector member of FIGS. 36 and 37.

FIG. 30 illustrates how three connector blocks 200 and/or block segments 250 may be effectively assembled in a three-row array by employing a larger clamp 258′ and a modified form of a spring clip 262′.

The spring-clip 262′ has inwardly-turned ends 264′, 264′ (like the ends 264, 264 on clip 262 in the FIG. 28 embodiment), and is further provided with a bowed portion 290 for establishing electrical connection between the wires in the top block segment and the intermediate block segment 250.

The three-high assembly or array shown in FIG. 30 is "free-floating" (i.e., is not secured to or mounted on a fixed structure). A vertical support wall 270′ is mounted against the rear surfaces of the block 200 and segment 250 by means of spaced ledges 272′ 274′, and the head 279′ and the end 281′ of the indexing finger 260 are bent back against the clamp 262′ and the support wall 270′, respectively.

The clamp 258′ is identical to the clamp 258 of the FIG. 28 embodiment, except that it is larger in height to secure three (rather than two) blocks 200 and/or block segments 250.

Although FIG. 30 shows two block segments 250, 250 stacked upon a connector block 200, it will, of course, be appreciated that 1, 2 or 3 block segments and/or blocks 200 may be arranged in a three-high stacked array using the clamp, spring-clip and fixture shown in FIG. 30.

The stacked block or module concept illustrated in FIGS. 27–30 is a particularly useful arrangement for connecting telephone wires at a neighborhood distribution point (e.g., a housing tract, a high-rise building, etc.). Use of the block segment concept (i.e., stacking block segments 250) on an elongated connector block 200 permits selected pairs of wires to be connected, disconnected, reconnected, etc. in the relatively compact array at any time.

The array shown in FIGS. 27 and 28 is assembled by first mounting the elongated connector block 200 on the temporary mounting structure 222 (FIG. 26), feeding the wires to be connected into the channels 202 with a portion of each wire bridging the cavity or socket 210 into which it is to be forced, and forcing a conductive insert or plug 54 into each socket or cavity 210 to substantially simultaneously pierce the insulation on the wire and establish electrical contact between the plug 54 and the wire and, substantially simultaneously, sever the terminal end portion of the wire (i.e., the end of the wire extending beyond the forward edge of the socket.

The connector block, with the wires attached, may then be mounted in an inverted or upside-down position on the bottom portion of the fixture 256 shown in FIGS. 27 and 28. Thereafter, individual block segments 250 are stacked bottom-to-bottom on the block 200, the wires to be connected in the segment are fed into their respective channels in bridging relation to the cavities or sockets in the segment, and the conductive plugs are applied to force the end portions of the wires into the cavities or sockets, pierce the wire insulation and sever the ends of the wires.

Clamps 258 are then applied to secure block segments 250 on the blocks 200 with the spring clips 262 establishing electrical connection between the associated conductive plugs 54 in the block segment 250 and the connector block 200.

Next, an index finger 260 is inserted through the slot 278 in the wall of the clamp 258 and through the channel formed by the aligned grooves 252 and 220 in the segment 250 and the block 200, respectively. The forward end of the shaft 280 of the finger 260 is secured to the horizontal wall of the fixture 256 by tightening the screw 282 (see FIG. 29), and the keeper bar 284 is inserted through the aperature 286 in the head 278 of the finger 260.

The connector block 300 shown in FIGS. 31–33 is similar to the connector block 200 shown in FIGS. 22–26. The block 300 differs from the block 200 in that (1) the wire retaining means on the uppe rear portion of the block is different, and (2) no transverse alignment grooves are provided in the bottom surface of the block 300 since the block 300 is not designed to be used in a stacked array. The block 300 is useful for connecting one, two or more wires in each socket 310 to one another and/or one or more wires in other sockets by inserting a conductive plug or slug 54 as described above in connection with the embodiment of FIGS. 4–9.

The block 300 includes channels 302, upstanding dividers 304, and cavities or sockets 310 which are substantially identical to the corresponding channels 202, dividers 204 and sockets 210 in the block 200 of FIGS. 22–26.

The connector block 300 (FIGS. 31–33) is also provided with transversely extending grooves 316, 320' in the upper and lower surfaces, respectively, adjacent the ends of the block and a longitudinally extending groove 318 in the rear surface thereof so that the block may be placed on a suitable mounting fixture, such as fixture 222 shown in FIG. 26.

The wire retaining means on the upper rear edge of the block 300 comprises a plurality of upstanding members 315, 315' having laterally extending flexible tongues 306. As best shown in FIG. 32, a relatively narrow wire-retaining slot 307 is formed between adjacent tongues 306 for receiving wires to be connected in the connector block 300, the said wire retaining slots being narrowest at the top, or entrance, to retain wires inserted therein.

It will be noted that the divider 315 extends higher than the adjacent dividers 315' and that the higher and lower dividers (315 and 315', respectively) are alternately arranged. By virtue of this alternate arrangement of the higher and lower dividers, the higher dividers 315 serve as pair splitters to assist the user in placing wires (e.g., "ring" and "tip" wires in the communications field).

The flexible tongues 306 serve to releasably retain wires in the slots 307.

The connector block 400 shown in FIGS. 34 and 35 is similar to the connector block 300 shown in FIGS. 31–33, but has a different wire retaining structure on the upper rear end thereof.

The block 400 includes channels 402, upstanding dividers 404, cavities or sockets 410 which are substantially identical to the corresponding channels, dividers and sockets in the blocks 200 and 300 of FIGS. 22–26 and FIGS. 31–33, respectively.

The connector block 400 (FIGS. 34–35) is also provided with transversely extending grooves 416, 420' in the upper and lower surfaces, respectively, adjacent the ends of the block and a longitudinally extending groove 418 so that the block may be placed on a suitable mounting fixture, such as fixture 222, shown in FIG. 26.

The wire retaining means on the upper rear edge of the block 400 comprises a plurality of upstanding sorter fingers 415, 415'. Wire retaining slots 407 are formed between adjacent edges of the fingers 415, 415' for receiving wires to be connected in the connector block 400.

It will be noted that the sorter fingers 415 extend higher than the adjacent sorter fingers 415' and that the higher and lower fingers (415 and 415', respectively) are alternately arranged. By virtue of this alternate arrangement of the higher and lower sorter fingers, the higher fingers 415 serve as pair splitters to assist the user in placing wire pairs (e.g., "ring" and "tip" wires in the communications field).

It will also be noted, from FIG. 35, that the edges of the fingers 415, 415' are relatively sharp, and function to strip insulation from the wires inserted therefrom. This is accomplished in the following manner. Referring to FIG. 35 a wire 450 is held in bridging relationship across the top of the connector block 400 and is then forced downwardly through the adjacent sharp edges of the sorter fingers 415, 415', into the slot 407. As the wire is forced into the slot 407, the relatively sharp edges of the adjacent fingers cut through the insulation on the wire but do not sever the wire. Thereafter, the wire is pulled forwardly (upwardly, as viewed in FIG. 35), thereby stripping the insulation from the portion of the wire so pulled. It is to be noted that the insulation which gathers at the rear surface of the block (see FIG. 35) provides a strain relief function to resist bending (and possible severing) of the wire immediately adjacent the rear edge of the block 400.

The electrical connection and severance function is provided in the same manner as the other connecting blocks disclosed herein; i.e., a conductive plug or insert is forced into the cavity or socket 410 which the wire 450 overlies, thereby forcing the wire into the socket and severing the terminal end portion thereof.

Figure 39:
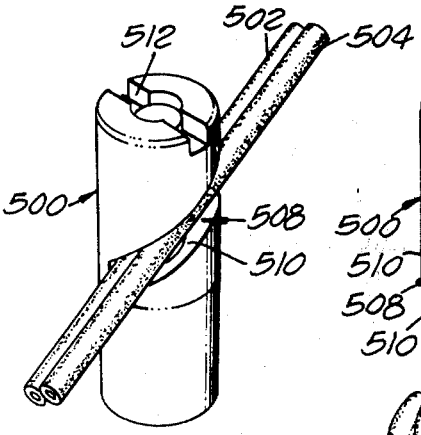
FIG. 39 is a perspective view illustrating the manner in which two wires to be electrically connected or "spliced" are placed in the connector member of FIGS. 36 and 37 preparatory to making the connection or splice.
Figure 40:
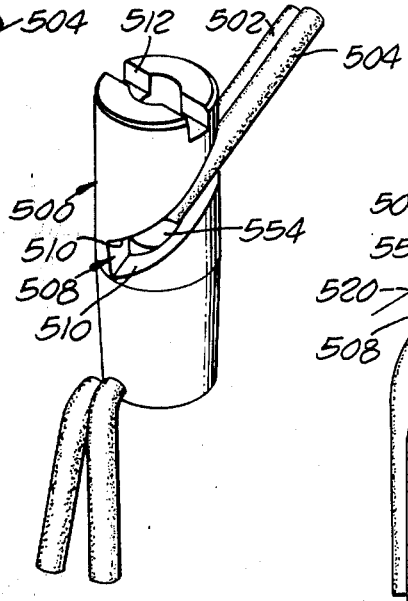
FIG. 40 is a perspective view similar to FIG. 39, illustrating the connector member and the wires after the wires have been connected or spliced in the connector member.
Figure 41:
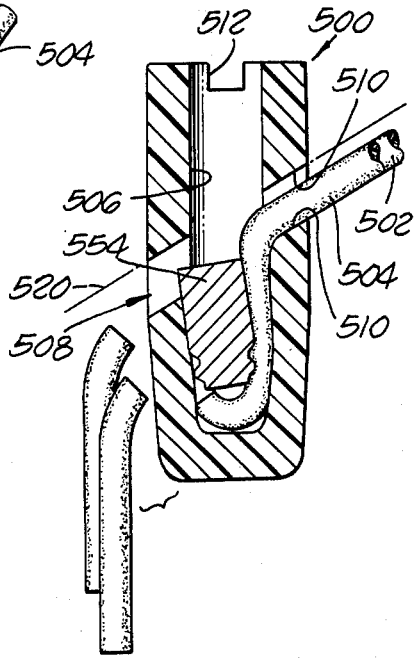
FIG. 41 is a sectional elevation view of the connector block-wire connection shown in FIG. 40.

FIGS. 36–41 illustrate a connector member 500 which is adapted to electrically connect a pair of wires (e.g., 502, 504, FIGS. 39–41).

The connector 500, which is particularly suited for household use, is of generally cylindrical configuration, is made of insulative material, and has a cylindrical cavity 506 extending from the top thereof and through a major portion of the length of the connector. A wire-receiving slot 508 is cut in the side wall of the connector and extends into communication with the cylindrical cavity 506. The surfaces 510, 510 which define the slot are inclined downwardly from the outer periphery of the slot to the inner periphery (i.e., where the slot joins the cavity 506), to force the wires (e.g., 502, 504) inserted in the slot into the cylindrical cavity 506.

A conductive plug or insert 554, similar to conductive insert 54 discussed above in conjunction with the embodiments of FIGS. 5–9, is snugly received and stored in the upper end of the cylindrical cavity 506. The plug is adapted to be forced downwardly by a suitable tool to electrically connect two wires inserted in the slot 508 and sever the terminal end portions of those wires. This is accomplished in the following manner.

As shown in FIG. 39, the wires to be joined, 502 and 504, are inserted into the inclined slot 508, the inwardly inclined surfaces 510, 510 thereof forcing the wires into the cylindrical cavity 506. Thereafter a suitable tool is employed to force the conductive plug 554 downwardly against the portion of the wires, 502 and 504, which extend across the cavity 506, thereby penetrating the insulation on that portion of the two wires and substantially simultaneously severing the end portions of the wires. This is illustrated in FIGS. 40 and 41.

As shown in FIG. 41, the conductive plug 554 remains in electrical contact with each of the wires, thereby electrically connecting the wires.

Since the upper portion of the connector 500 serves no function after the connection has been made (i.e., after the wires have been joined and the terminal ends severed) it is contemplated that the upper half of the connector (i.e., the portion of the connector 500 above the phantom line 520 in FIG. 41) may be snapped off or cut away to reduce the space occupied by the finished connection.

It is contemplated that while connectors 500 may be utilized individually to electrically connect pairs of wires, the connectors may be loaded in quantities in a suitable tool and fed from the tool, one at a time, to a position where wires to be joined may be inserted into the slot 508 and driven by the slug or plug 554 to penetrate the insulation, establish electrical connection and sever the terminal ends. A transverse slot 512 may be provided in the upper end of the connector body, as shown in FIGS. 36–41, to index the connector in such a tool so that the slot 508 will be positioned in the tool to receive the wires to be connected.

Of course, numerous modifications and changes may be made to the particular embodiments described above without departing from the spirit and scope of the present invention. Accordingly, it is intended that the scope of protection of this patent be limited only by the following claims.

I claim:

1. An electrical connector member comprising:

a generally elongated body member of insulative material;

a plurality of wire-receiving channels extending across one surface of said body member;

an upstanding divider wall separating each said channel from each adjacent channel; each said divider wall extending substantially across said one surface of said body member;

laterally projecting means on one end of each said divider wall; said laterally projecting means extending into the end portions of said channels to form releasable wire retaining means;

a relatively sharp cutting edge in each said channel; insulation penetrating means associated with each said channel;

force transfer means associated with each of said channels adapted to penetrate the insulation on at least one wire in each channel, to establish electrical connection therewith, and to sever simultaneously the terminal end portion of said wire in cooperation with said relatively sharp cutting edge.

2. An electrical connector member according to claim 1, wherein said laterally projecting means on said one end of each divider wall has a relatively sharp edge; each said relatively sharp edge being adapted to cooperate with the edge of an adjacent lateral projection in its associated channel to strip the insulation on a wire inserted in said channel and pulled transversely relative thereto.

3. An electrical connector member according to claim 1 further comprising groove means in one surface thereof for snugly receiving a ledge of a support fixture to support said member thereon during placement of wires therein.

* * * * *